US006227830B1

(12) United States Patent
Fields et al.

(10) Patent No.: US 6,227,830 B1
(45) Date of Patent: May 8, 2001

(54) CHECK VALVE MOUNTED ADJACENT SCROLL COMPRESSOR OUTLET

(75) Inventors: Gene Michael Fields, Arkadelphia, AR (US); Joe T. Hill, Bristol, VA (US); John R. Williams, Bristol, VA (US); Tracy L. Milliff, Bristol, VA (US); Michael R. Young, Bristol, TN (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/366,808

(22) Filed: Aug. 4, 1999

(51) Int. Cl.[7] ..... F04C 18/04; F16K 15/02
(52) U.S. Cl. ..... 418/55.1; 418/270; 137/533.17
(58) Field of Search ..... 418/5.1, 270; 137/533, 137/533.17, 533.19

(56) References Cited

U.S. PATENT DOCUMENTS

| | | | |
|---|---|---|---|
| 5,173,042 | 12/1992 | Chambers | 418/55.1 |
| 5,263,822 | 11/1993 | Fujio | 418/55.4 |
| 5,395,214 | 3/1995 | Kawahara et al. | 418/55.1 |
| 5,451,148 | 9/1995 | Matsuzaki et al. | 418/55.1 |
| 5,494,422 | 2/1996 | Ukai et al. | 418/55.1 |
| 5,622,487 | 4/1997 | Fukuhara et al. | 418/55.2 |
| 6,065,948 * | 5/2000 | Brown | 418/55.1 |

FOREIGN PATENT DOCUMENTS

| | | | |
|---|---|---|---|
| 59-23094 * | 2/1984 | (JP) | 418/55.1 |
| 3-242483 * | 10/1991 | (JP) | 418/55.1 |
| 5-113186 * | 5/1993 | (JP) | 418/55.1 |
| 5-157067 * | 6/1993 | (JP) | 418/55.1 |
| 5-272472 * | 10/1993 | (JP) | 418/270 |

* cited by examiner

*Primary Examiner*—John J. Vrablik
(74) *Attorney, Agent, or Firm*—Carlson, Gaskey & Olds

(57) ABSTRACT

Several discharge check valve arrangements for scroll compressors move the check valve closer to the discharge port and the compression chambers. This reduces the amount of discharge pressure backflow, and thus reduces the amount of reverse rotation at shutdown. In one type of check valve arrangement, a plug is mounted within a check valve chamber to provide a stop for the check valve. The plug allows the check valve to seat against its valve seat while the compressor is operating to allow gas to flow around the check valve into a discharge plenum. At shutdown, the check valve arrangement is constructed to cause the check valve to rapidly close the discharge port. In other arrangements, the discharge check valve assembly may be mounted in a separator plate as a separate valve plug. This embodiment is similar to an earlier embodiment in the basic operation of the check valve.

3 Claims, 3 Drawing Sheets

CHECK VALVE MOUNTED ADJACENT SCROLL COMPRESSOR OUTLET

BACKGROUND OF THE INVENTION

This application relates to a variety of scroll compressor discharge check valve locations which are positioned relatively close to the discharge opening from the compression chambers.

Scroll compressors have become widely utilized in many refrigerant compression applications. Scroll compressors are relatively efficient, and thus are being utilized in more and more applications. In a typical scroll compressor, the compression chambers are defined by two generally spiral wraps. The spiral wraps are formed on individual scroll members, and extend from a base plate. The spiral wraps interfit to define compression chambers. One of the spiral wraps is driven to orbit relative to the other, and the size of the compression chambers changes to compress the entrapped refrigerant.

As the compression chamber nears the end of its cycle, the entrapped gas is exposed to a discharge port. The entrapped gas leaves the discharge port and moves through a check valve to a discharge plenum. The discharge check valve is typically opened during operation of the scroll compressor. The check valve closes the discharge port and desirably prevents backflow once the compressor is stopped.

In scroll compressors there is a phenomenon known as reverse rotation. This occurs when as compressed gas moves back through the discharge port and into the compression chamber to drive the scroll compressor wraps relative to each other in a reverse direction at shutdown of the compressor. This is undesirable, and results in unwanted noise and potential harm to the compressor components.

One method of minimizing the amount of reverse rotation is to minimize the volume of compressed gas which will move between the scroll wraps at shutdown. The present invention is directed to optimizing the location of the check valve to minimize the volume gas which is likely to move back into the compression chambers.

SUMMARY OF THE INVENTION

In a disclosed embodiment of this invention, the base of a scroll compressor wrap is formed with the discharge port and also receives the discharge check valve in an enclosed chamber. A stop for the check valve is also preferably formed in the base plate.

In a first embodiment, the discharge fluid moves through the discharge port and into a discharge check valve chamber formed in the base plate in a first direction. The gas in the discharge check valve chamber then communicates with a radially outwardly directed outlet port to pass outwardly through the base plate and into a discharge plenum. An opening at the opposed end of the base plate from the discharge port is provided with a stop which provides a check valve seat. The check valve seat is provided with a tap which communicates to a discharge pressure chamber.

At shutdown, the discharge pressure in the discharge pressure chamber rapidly biases the check valve to its closed position. Mounting the check valve within the base plate insures that the distance between the check valve and the compression chambers in the scroll compressor is relatively small. This minimizes the amount of backflow discharge fluid, and hence minimizes the amount of reverse rotation.

In other embodiments, the same basic arrangement is used. However, the outlet ports are formed at circumferentially spaced locations around a plug which forms the check valve stop. Thus, the fluid flows into the check valve chamber in the base of the scroll member, and then flows radially outwardly, to ports. The outlet ports have a first port that extends generally perpendicular to the discharge port, and a second portion which extends parallel to the discharge port and which communicates to the discharge pressure chamber.

In another embodiment, a separate plug is utilized which extends into the discharge port. The plug is mounted within a separator plate spaced upwardly from the scroll wrap base plate. The plug is provided with a check valve chamber and a stop at an opposed end formed by a closure plug. The stop has an opening which extends through to a chamber at discharge pressure such that the check valve will rapidly close.

These and other features of the present invention can be best understood from the following specification and drawings, the following of which is a brief description.

DETAILED DESCRIPTION OF A PREFERRED EMBODIMENT

Figure 1:
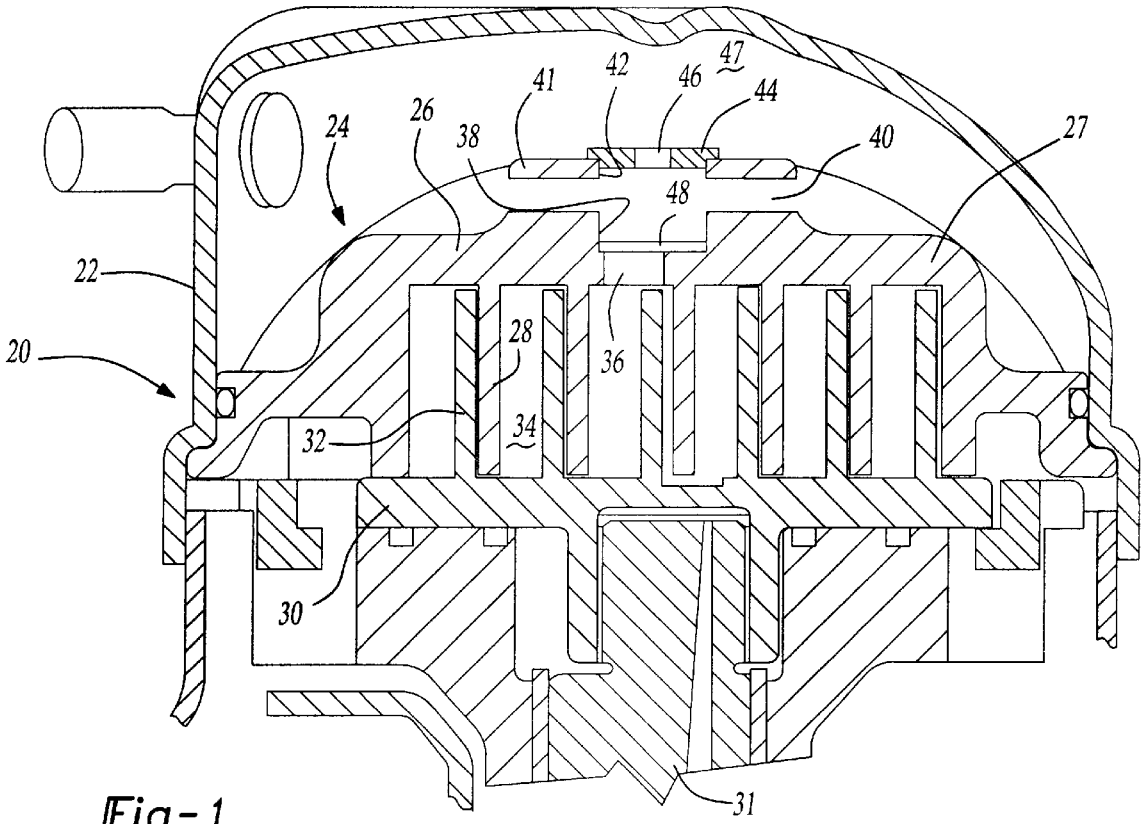
FIG. 1 shows a first embodiment scroll compressor according to this invention.

FIG. 1 shows a scroll compressor 20 including an outer housing cap 22 enclosing a pump unit 24. The pump unit 24 includes a first scroll member 26, which incorporates a base plate 27 with a wrap 28 extending from the base plate. A second scroll member 30 incorporates a wrap 32 extending from its base plate. A shaft 31 drives the second scroll member 30 to orbit. As the scroll wraps 28 and 32 orbit relative to each other, chambers, such as chamber 34, are reduced in size to compress and entrap fluid. Eventually, chamber 34 is exposed to a discharge port 36 extending through the base plate 27. Port 36 communicates with a check valve chamber 38 formed in the base plate 27. A plurality of radially extending outlet ports 40 extend outwardly through a dome 41 also formed in the base plate 27.

An upper opening 42 in the dome 41 receives a closure plug 44, or retainer, which provides a stop surface for a valve 48. A discharge pressure chamber 47 communicates with the opening 46 and outlet ports 40.

When the compressor is running, shaft 31 drives the scroll member 30 in a forward direction. Gas is compressed in the chambers 34 and moves outwardly through the discharge port 36, into the chamber 38 and then outwardly through the ports 40 to chamber 47. This discharge pressure gas drives the check valve 48 upwardly against the plug 44. At shutdown, the pressure within the chambers 34 drops rapidly. Thus, high pressure at port 36 no longer drives the check valve 48 upwardly. Instead, the pressure in the chamber 47 remains high and communicates through the opening 46 to drive the check valve 48 back downwardly to close the port 36. In this way, the amount of gas which escapes around the check valve 48 and back into the compression chambers through the port 36 is minimized. Also, the simplicity of the design and proximity to the compression chambers is improved. This is an improvement over the prior art. Further, since the check valve is in the base plate 27, it is close to the discharge port, and thus it reduces the volume of gas between the check valve 48 and the chambers 34. This minimizes unwanted backspin.

Figure 2:
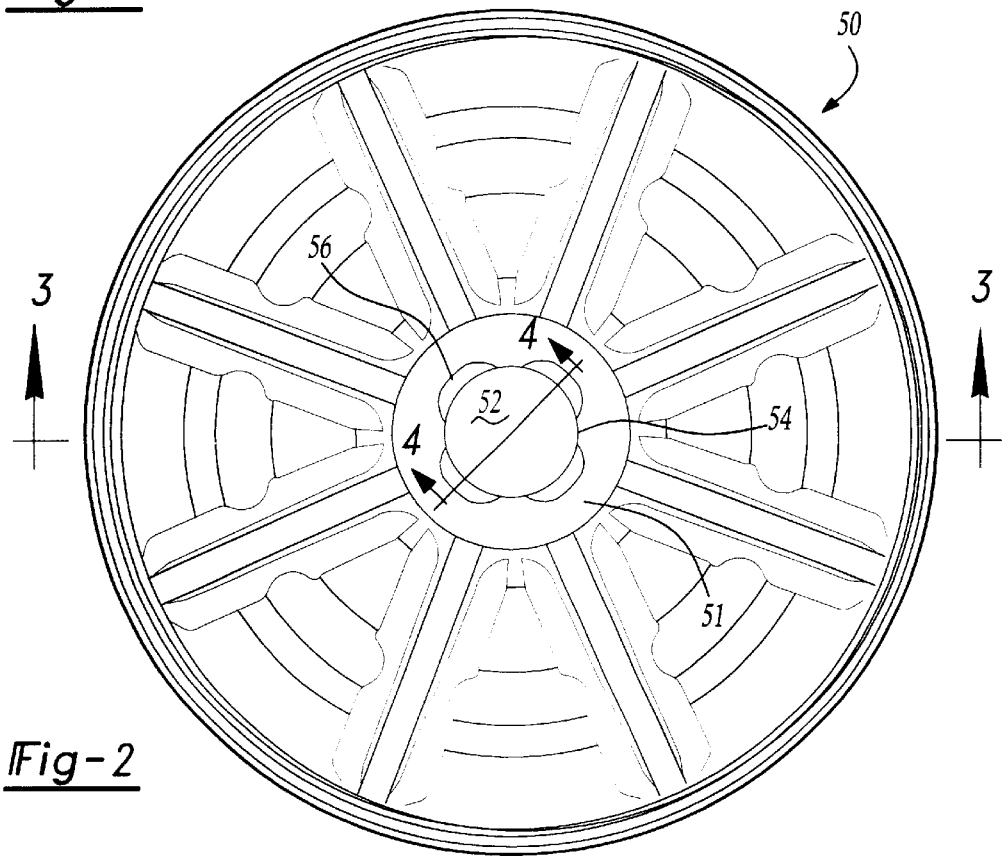
FIG. 2 shows a second embodiment scroll compressor.

FIG. 2 shows a second embodiment 50 having a central dome 51 receiving a closure plug 52. As shown, guide areas 54 from the dome 51 contact the plug 52 at circumferentially spaced locations to allow a simple press fit. Also, outlet ports 56 are circumferentially spaced on opposed sides of the sealing areas 54.

The FIG. 2 embodiment may also be utilized with a hole such as hole 46 from the FIG. 1 embodiment. However, it should be understood that the structure can also function without the hole.

Figure 3:
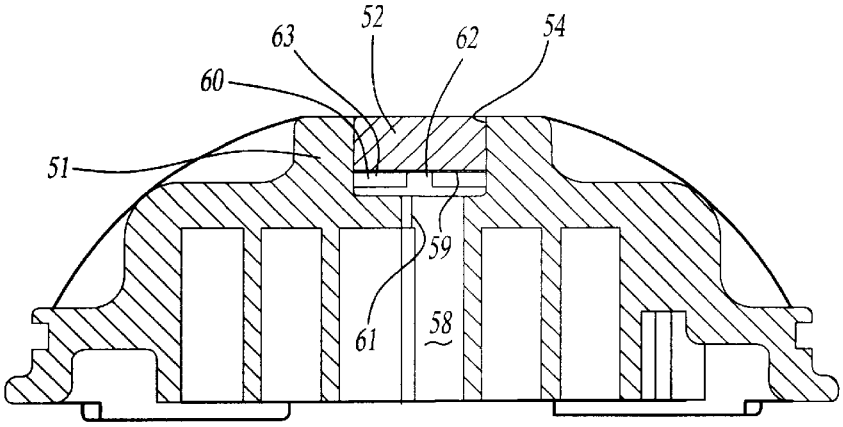
FIG. 3 is a cross-sectional view along line 3—3 as shown in FIG. 2.

As can be seen in FIG. 3, the chamber 58 communicates through the discharge port 61 into a check valve chamber 60. A check valve 59 is shown biased upwardly against the plug 52. Webs 62 define outlet openings 63.

Figure 4A:
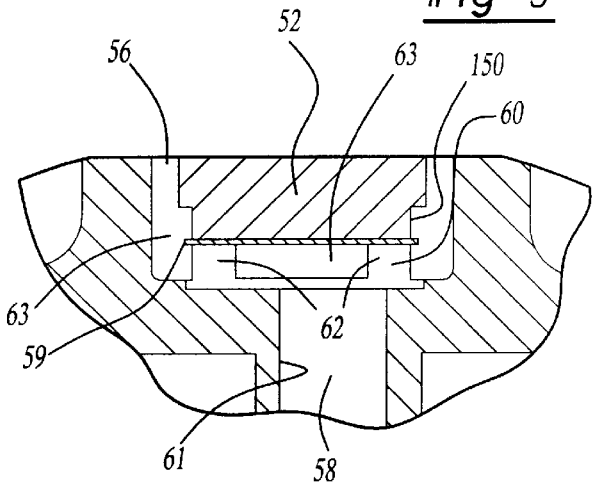
FIG. 4A is a cross-sectional view along line 4—4 as shown in FIG. 2.

As shown in FIG. 4A, openings 63 extend perpendicular to port 61, and communicate to outlet ports 56. Ports 56 extend parallel to port 61. Thus, during normal operation compressed gas can flow through the port 61, into the chamber 60, through the opening 63, and to the ports 56. However, at shutdown, the valve 59 will again rapidly close.

As shown, an undercut portion 150 is formed into the plug 52. The undercut portion reduces the amount of contact area between the plug 52 and the valve disc 59. This will reduce the tendency for the valve disc to "stick", and facilitate movement of the disc 59 downwardly to the closed position.

Figure 4B:
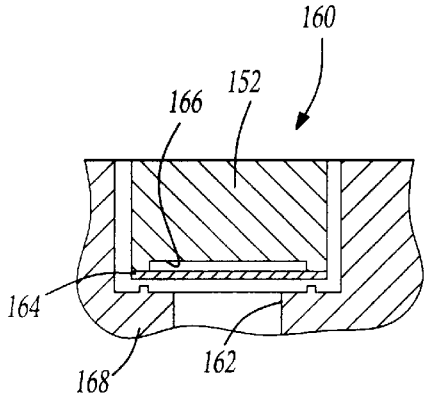
FIG. 4B is an alternative embodiment.

FIG. 4B shows another embodiment, which is quite similar to the FIG. 4A embodiment. In the FIG. 4B embodiment 160, the plug 152 is structured similar to the plug 52 in the FIG. 4A embodiment. The valve disc 164 abuts the plug 152 in the open position. As shown, an inner recess 166 is provided to reduce the tendency to "stick" that was provided by the undercut 150 in the FIG. 4A embodiment. In the FIG. 4B embodiment, a sealing ring 168 surrounds the discharge port 162 to provide seal with the valve 164.

Figure 5:
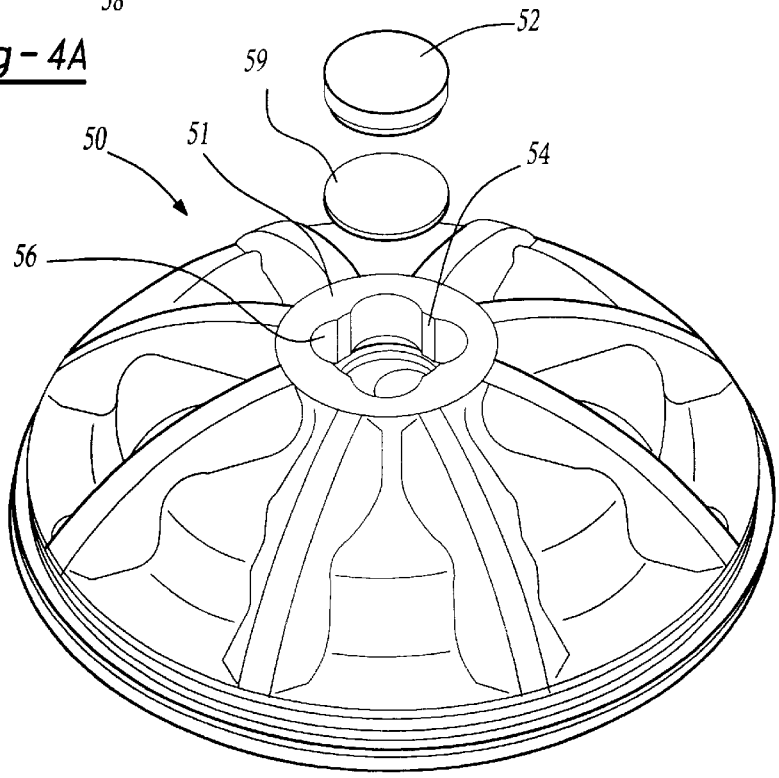
FIG. 5 is an exploded view of the device shown in FIG. 2.

FIG. 5 shows details of the structure 50 including the boss 51, the valve 59 and the plug 52. The valve guide areas 54 and the ports 56 can also be seen circumferentially spaced about the opening in the boss 51.

Figure 6:
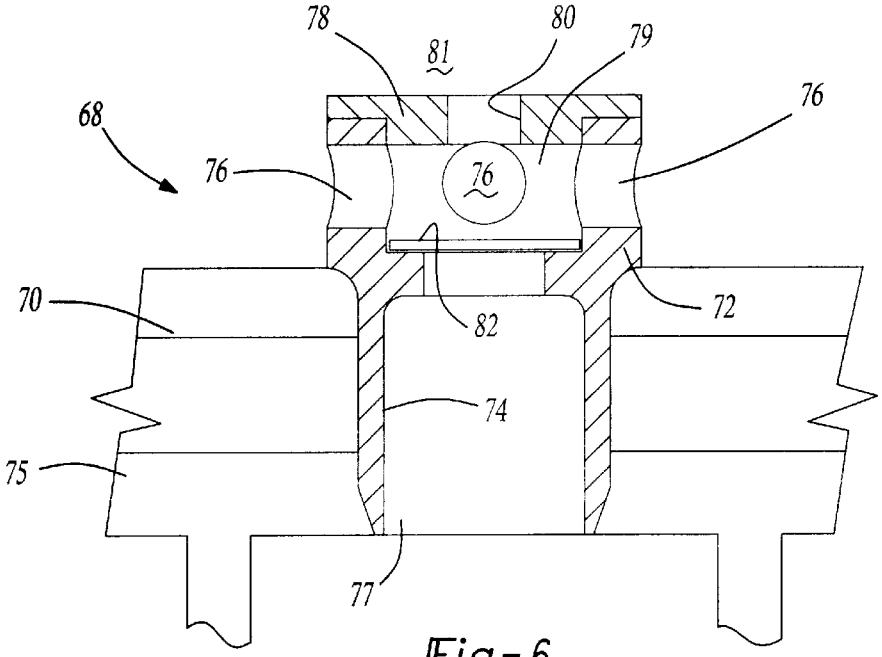
FIG. 6 shows another embodiment scroll compressor.

FIG. 6 shows another embodiment 68 which is mounted in a separator plate 70. A valve housing or plug 72 is mounted within the separator plate 70 and has an extension 74 extending downwardly into the base 75 of the scroll member, to communicate to the discharge port 77. As shown, gas can pass through the valve plug 72 and into a check valve chamber 79. Chamber 79 has ports 76 extending radially outwardly, similar to the first embodiment. A closure plug 78 encloses an end of the valve plug 72 and includes an opening 80 which communicates with a discharge pressure chamber 81. Chamber 81 is also at discharge pressure. The valve 82 is mounted adjacent the port 77, and functions similar to the valve in the FIG. 1 embodiment. As with the first embodiment, at shutdown gas in chamber 81 moves through opening 80 to bias the valve 82 to the closed position such as shown in FIG. 6.

Figure 7:
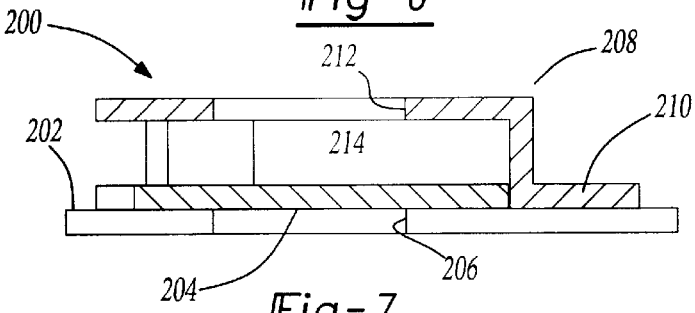
FIG. 7 shows another embodiment scroll compressor.

Another embodiment 200 is illustrated in FIG. 7 mounted above a separator plate 202. The valve disc 204 selectively closes a discharge port 206. A retainer or plug 208 sits atop the separator plate 202. A plurality of legs 210 are secured to the separator plate 202 such as by welds. A discharge pressure tap opening 212 extends through the top of the plug 208. Openings 214 are spaced between the legs 210. The underside of the plug 208 can be disturbed to minimize the contact area between the valve disc and the plug. As examples, the underlying surface can be spherical, dimpled, burred, or formed on a radius.

Figure 8:
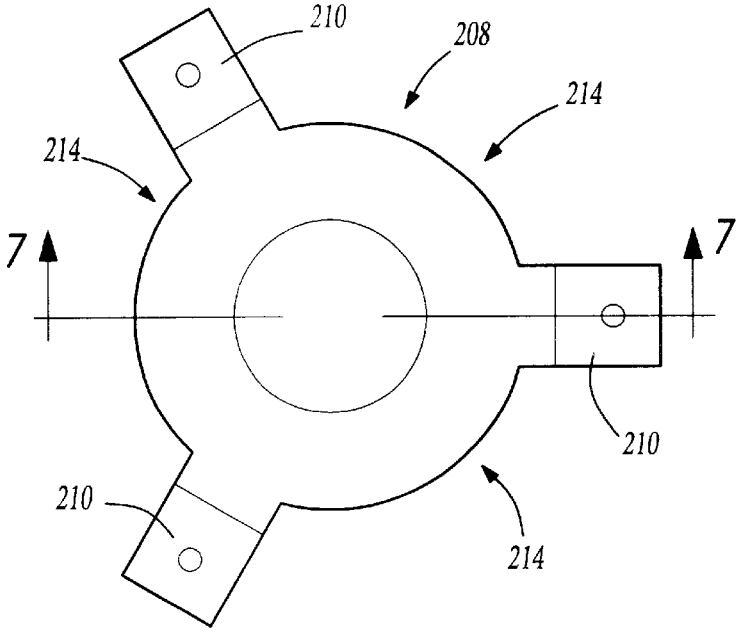
FIG. 8 shows another portion of the FIG. 7 embodiment.

As shown in FIG. 8, the legs 210 are spaced circumferentially and interspaced with spaces 214. The width of the spaces 214 is insufficient to allow the disc 214 to move outwardly between the legs 210. This embodiment works similar to the earlier embodiments in providing prompt closing of the valve.

Although preferred embodiments of this invention have been disclosed, a worker of ordinary skill in this art would recognize that modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, said generally spiral wraps of said first and second scroll members interfitting to define compression chambers, and said second scroll member being driven to orbit relative to said first scroll member;

said first scroll member base being formed with a discharge port for communicating at least one of said compression chambers to an outlet destination for a compressed gas;

a check valve assembly within said base plate of said first scroll member, said check valve assembly including a check valve chamber formed in said base plate and communicating with said discharge port, a check valve mounted within said check valve chamber, and a plug having a face blocking flow of refrigerant through said plug from an end of said plug remote from said discharge port, said plug mounted on an opposed side of said check valve from said discharge port, said plug defining a stop for said check valve, and said plug having a recessed portion extending into a face adjacent said port, and outlet ports extending radially outwardly to circumferentially spaced discharge passages, for communicating said check valve chamber to a discharge chamber.

2. A scroll compressor as recited in claim 1, wherein said recessed portion does not communicate with said discharge chamber when said check valve is on said stop.

3. A scroll compressor as recited in claim 1, wherein said plug is a solid body.

* * * * *